United States Patent [19]

Leifeld

[11] 4,287,643

[45] Sep. 8, 1981

[54] CARDING ELEMENT

[75] Inventor: Ferdinand Leifeld, Kempen, Fed. Rep. of Germany

[73] Assignee: Trutzschler GmbH & Co., Mochengladbach, Fed. Rep. of Germany

[21] Appl. No.: 940,658

[22] Filed: Sep. 8, 1978

[30] Foreign Application Priority Data

Sep. 13, 1977 [DE] Fed. Rep. of Germany ..... 2741088

[51] Int. Cl.[3] ..... D01G 15/84

[52] U.S. Cl. ..... 19/114; 75/123 M

[58] Field of Search ..... 19/112–114, 19/105, 97; 75/236, 123 M; 428/603

[56] References Cited

U.S. PATENT DOCUMENTS

| | | | |
|---|---|---|---|
| 3,387,338 | 6/1968 | Kanai et al. | 19/114 |
| 3,416,976 | 12/1968 | Brill-Edwards | 75/236 X |
| 3,604,062 | 9/1971 | Hollingsworth | 19/113 |
| 3,720,504 | 3/1973 | Frehn | 75/236 X |
| 3,833,968 | 9/1974 | Aria et al. | 19/114 |
| 3,853,494 | 12/1974 | Graf | 19/114 X |

FOREIGN PATENT DOCUMENTS

| | | | |
|---|---|---|---|
| 2364983 | 4/1978 | France | 19/105 |
| 400971 | 11/1933 | United Kingdom | 19/113 |
| 308114 | 5/1972 | U.S.S.R. | 19/105 |

*Primary Examiner*—Louis Rimrodt

*Attorney, Agent, or Firm*—Haseltine and Lake

[57] ABSTRACT

A carding element in which a tooth set uses steel and is arranged on a base plate. The tooth set is made of steel-bound hard material. This material, furthermore, contain titanium carbide up to substantially 50% by volume. The steel-bound hard material may also be used for the tooth set of a fixed cover, or of a comb segment located underneath a taker in.

5 Claims, 2 Drawing Figures

CARDING ELEMENT

BACKGROUND OF THE INVENTION

1. Field of the Invention

The present invention relates to a carding element where a tooth segment is fastened on a base plate with the use of steel.

2. Prior Art

A known carding element uses alloyed iron or alloyed steel as material for the tooth set. The desired hardness of these teeth is achieved by the particular alloying additives, e.g., silicon, manganese, vanadium. However, this tooth set has the disadvantage that a certain hardness may not be exceeded since the material otherwise cannot be machined because of high brittleness. Also, with excessive brittleness there is the danger of fractures so that operational troubles may arise. Furthermore, it is troublesome that the wear resistance is not high enough.

OBJECTS OF THE INVENTION

Accordingly, it is an object of the present invention to provide a carding element which avoids the disadvantages mentioned, and combines a high hardness and hence high wear resistance with a longer service life, avoiding operational troubles due to fractures.

Another object of the present invention is to provide a carding element of the foregoing character, which may be economically fabricated and readily maintained and serviced.

A further object of the present invention is to provide a carding element, as described, which is substantially simple in construction.

SUMMARY OF THE INVENTION

The objects of the present invention are achieved by using steel-bound hard material for the tooth set.

Through the use of steel-bound hard material, the tooth set can be both machined and hardened. First, a semifinished piece, e.g., in the form of a strip, is placed on the carding element, e.g., a support member constituted as a fixed carding segment or a fixed cover. Since the base material of these tools is steel, the elasticity required for bending is provided. Since steel can be easily machined, a sawtooth-shaped tooth set can be produced in a simple manner. Then the base material made of steel is hardened by heating and quenching, if necessary, with subsequent annealing. Together with extremely high hardness of the bound hard material, the hardened steel base material provides the tooth set of the carding element with high wear resistance. Because the steel-bound hard material is machinable and hardenable, there is a great advantage for machining and application, combining good machinability through elasticity and chippability with excellent wear resistance through high hardness. By annealing, the hardness can be adjusted in such a way that fracture of the tooth set is avoided during operation.

In accordance with its purpose, the steel-bound hard material contains up to 50% by volume of titanium carbide since the material can be machined without problems up to this percentage. It is preferable to use steel-bound hard material for the tooth segment of a fixed cover and for the tooth segment of a comb segment located underneath the taken-in, since a semifinished plate can be used for producing these tooth sets.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE PREFERRED EMBODIMENTS

Figure 1:
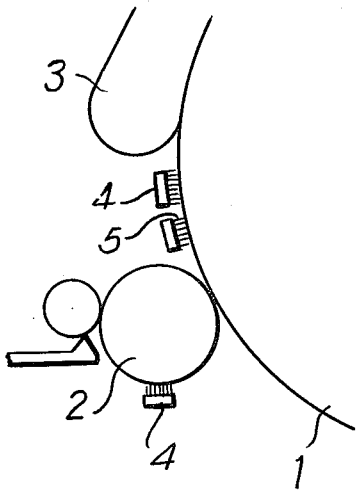
FIG. 1 shows a carding element in accordance with the present invention as a comb segment on the drum of a card.

FIG. 1 shows a drum 1 of a card where, between a taker-in 2 and a traveling cover 3 serving as a carding element, there are two comb seqments 4. Underneath the taker-in 2, there is provided a further comb segment 4. The teeth 5 of the comb segments are made of steel-bound hard material.

Figure 2:
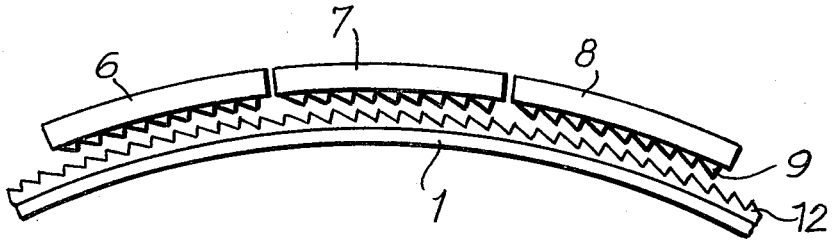
FIG. 2 shows a carding element in accordance with the present invention as a fixed cover.

FIG. 2 shows a drum 1 of a card with a tooth set 12. Above the drum 1, fixed covers 6, 7, 8 with sawtooth-shaped teeth segments 9 made of steel-bound hard material are provided as carding elements.

Without further analysis, the foregoing will so fully reveal the gist of the present invention that others can, be applying current knowledge readily adapt it for various applications without omitting features that, from the standpoint of prior art, fairly consistutes essential characteristics of the generic or specific aspects of this invention, and therefore, such adaptions should and are intended to be comprehended within the meaning and range of equivalence of the following claims.

What is claimed is:

1. A carding element comprising: a support member; and a tooth set arranged on said support member and comprised of an alloy of steel-bound hard material containing up to 50% titanium carbide by volume, said tooth set being mounted on said support member in semifinished, machined state and hardened in situ by heating and quenching.

2. A carding element as claimed in claim 1 wherein said support member comprises a fixed cover.

3. A carding element as claimed in claim 2 wherein said fixed cover includes a plurality of adjacent fixed cover elements, each having a respective tooth set.

4. Carding apparatus including a taker-in and a comb segment located underneath said taker-in; said comb segment being constituted as the carding element in claim 1.

5. Carding apparatus as claimed in claim 4 comprising a drum cooperating with said taker-in and a further comb segment cooperating with said drum after said taker-in.

* * * * *